US009575448B2

(12) United States Patent
Okajima

(10) Patent No.: US 9,575,448 B2
(45) Date of Patent: Feb. 21, 2017

(54) FIXING DEVICE HAVING A ROTATION TRANSFER MEMBER AND IMAGE FORMING APPARATUS INCLUDING THE SAME

(71) Applicant: KYOCERA Document Solutions Inc., Osaka (JP)

(72) Inventor: Yasuhito Okajima, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/011,958

(22) Filed: Feb. 1, 2016

(65) Prior Publication Data

US 2016/0223966 A1 Aug. 4, 2016

(30) Foreign Application Priority Data

Jan. 30, 2015 (JP) ..... 2015-017507

(51) Int. Cl.
*G03G 15/20* (2006.01)

(52) U.S. Cl.
CPC .. *G03G 15/2053* (2013.01); *G03G 2215/2035* (2013.01)

(58) Field of Classification Search
CPC ..... G03G 15/2053
USPC ..... 399/329
See application file for complete search history.

(56) References Cited

U.S. PATENT DOCUMENTS

| | | | | |
|---|---|---|---|---|
| 9,046,834 | B2 | 6/2015 | Egi | |
| 2014/0072352 | A1* | 3/2014 | Naito | G03G 15/2053 399/329 |
| 2015/0050056 | A1* | 2/2015 | Kondo | G03G 15/2017 399/329 |
| 2016/0132003 | A1* | 5/2016 | Koda | G03G 15/2053 399/329 |
| 2016/0179043 | A1* | 6/2016 | Kawaguchi | G03G 15/2053 399/329 |

* cited by examiner

*Primary Examiner* — Quana M Grainger
(74) *Attorney, Agent, or Firm* — Wenderoth, Lind & Ponack, L.L.P.

(57) ABSTRACT

In a fixing device including a pressure roller brought into press-contact with a fixing belt, a cylindrical part arranged to cover an outer peripheral surface of an end portion of the fixing belt in a rotation shaft direction, a rotation transfer member formed in an approximately annular shape by allowing two facing end edges of a rectangular sheet material to be brought close to each other, and held between an inner peripheral surface of the cylindrical part and an outer peripheral surface of the fixing belt, a bonding material for bonding the rotation transfer member to the inner peripheral surface of the cylindrical part, and a rotation detection unit that detects rotation of the cylindrical part, the cylindrical part is formed at the inner peripheral surface thereof with a storage recessed portion that stores an end edge of the rotation transfer member, positioned at a downstream side.

5 Claims, 5 Drawing Sheets

FIXING DEVICE HAVING A ROTATION TRANSFER MEMBER AND IMAGE FORMING APPARATUS INCLUDING THE SAME

CROSS-REFERENCE TO RELATED APPLICATION

This application is based upon and claims the benefit of priority from Japanese Patent Application No. 2015-17507 filed on Jan. 30, 2015, the entire contents of which are incorporated herein by reference.

BACKGROUND

The technology of the present disclosure relates to a fixing device and an image forming apparatus including the same.

Conventionally, there has been known a fixing device including an endless fixing belt heated by a heating unit, a pressing pad abutting an inner peripheral surface of the fixing belt, and a pressure roller brought into press-contact with the pressing pad at a predetermined pressure while interposing the fixing belt between the pressing pad and the pressure roller. The pressure roller forms a fixing nip portion between the fixing belt and the pressure roller and applies rotational driving force to the fixing belt.

In this type of fixing device, when the fixing belt slips with respect to the pressure roller, there is a problem that the fixing belt is locally heated by the heating unit and thus is broken. In order to avoid such a problem, there has been proposed a fixing device in which a cap member is mounted at an end portion of the fixing belt in a rotation shaft direction and rotation of the cap member is detected by a rotation detection unit, so that rotation of the fixing belt is indirectly detected. In this fixing device, only when the rotation of the cap member (that is, the fixing belt) has been detected by the rotation detection unit, the heating unit is operated. The cap member has a cylindrical part that covers an outer peripheral surface of an end portion of the fixing belt and a disc part that covers one end side of the cylindrical part.

A rotation transfer member is mounted at an inner peripheral surface of the cylindrical part to transfer the rotation of the fixing belt to the cap member. The rotation transfer member is configured by an elastic member and has been bonded to the peripheral surface of the cylindrical part by a bonding material such as an adhesive tape. The rotation transfer member is formed in an annular shape by allowing two facing end edges of a rectangular sheet material to abut with each other. The rotation transfer member makes contact with the outer peripheral surface of the fixing belt and transfers the rotation of the fixing belt to the cap member. The rotation transfer member is compressively deformed at a contact part with the fixing belt to ensure contact pressure.

SUMMARY

A fixing device according to one aspect of the present disclosure includes an endless fixing belt, a heating unit, an abutting member, a pressure roller, a cylindrical part, a rotation transfer member, a bonding material, and a rotation detection unit. The heating unit heats the fixing belt. The abutting member is arranged inside the aforementioned fixing belt and abuts an inner peripheral surface of the fixing belt. The pressure roller is brought into press-contact with the aforementioned abutting member at a predetermined pressure while interposing the aforementioned fixing belt between the abutting member and the pressure roller, thereby forming a fixing nip portion between the aforementioned fixing belt and the pressure roller and applying rotational driving force to the aforementioned fixing belt in a predetermined direction. The cylindrical part is arranged to cover an outer peripheral surface of an end portion of the aforementioned fixing belt in a rotation shaft direction. The rotation transfer member is formed in an approximately annular shape by allowing two facing end edges of a rectangular sheet material including an elastic member to be brought close to each other, and held between an inner peripheral surface of the aforementioned cylindrical part and an outer peripheral surface of the aforementioned fixing belt to transfer the rotation of the aforementioned fixing belt to the aforementioned cylindrical part. The bonding material bonds the aforementioned rotation transfer member to the inner peripheral surface of the aforementioned cylindrical part. The rotation detection unit detects the rotation of the aforementioned cylindrical part.

Furthermore, the aforementioned cylindrical part is formed at the inner peripheral surface thereof with a first storage recessed portion that stores an end edge positioned at a downstream side in a belt rotation direction of the aforementioned two facing end edges in the aforementioned rotation transfer member.

DETAILED DESCRIPTION

Hereinafter, an example of an embodiment will be described in detail on the basis of the drawings. It is noted that the technology of the present disclosure is not limited to the following embodiments.

Embodiment 1

Figure 1:
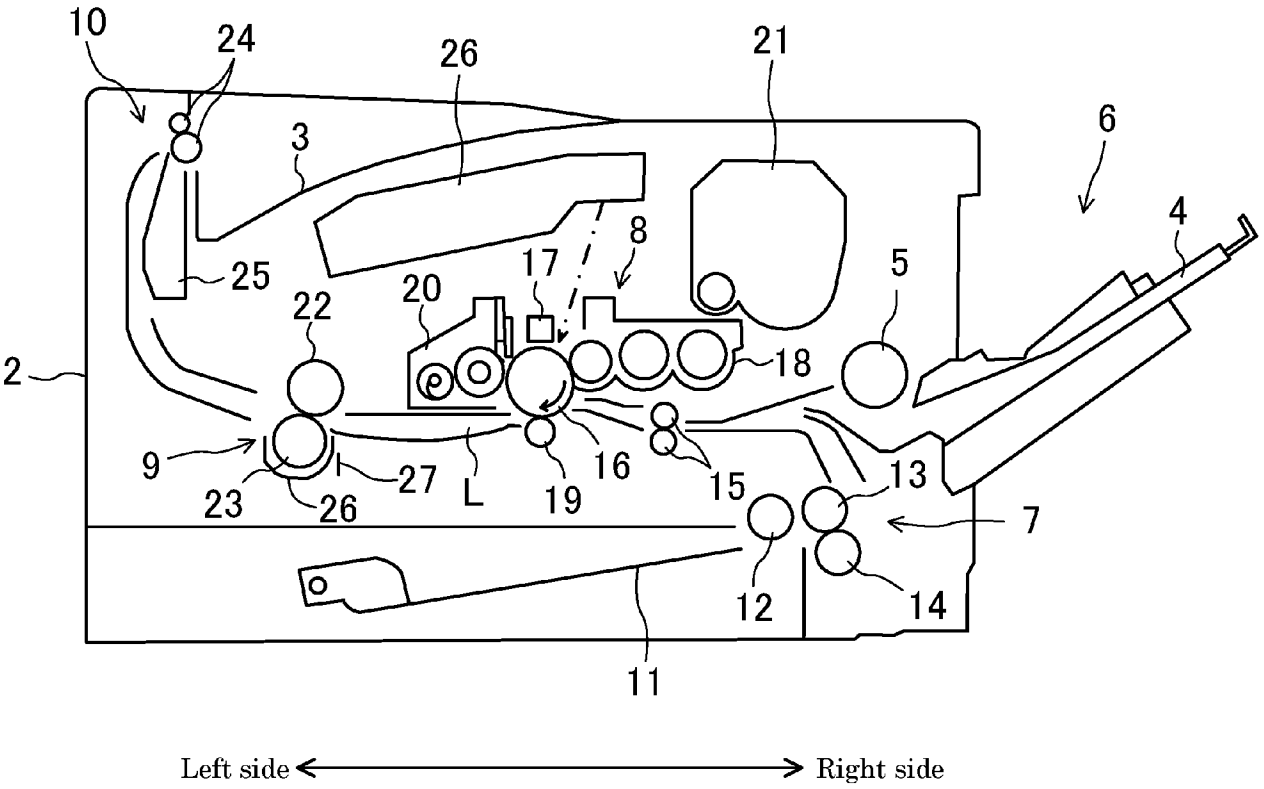
FIG. 1 is a schematic diagram illustrating an internal structure of an image forming apparatus including a fixing device in an embodiment.

FIG. 1 a schematic diagram illustrating a laser printer, which is an example of an image forming apparatus 1 in the present embodiment. In the following description, a "front" and a "rear" indicate a front side and a rear side of the image forming apparatus 1, and a "left" and a "right" indicate a left side and a right side when the image forming apparatus 1 is viewed from the front side.

As illustrated in FIG. 1, the image forming apparatus 1 includes a box-like printer body 2, a manual paper feeding unit 6, a cassette paper feeding unit 7, an image forming unit 8, a fixing device 9, and a paper discharge unit 10. In this way, the image forming apparatus 1 is configured to form an image on a paper on the basis of image data transmitted from a terminal and the like (not illustrated) while conveying the paper along a conveyance path T in the printer body 2.

The manual paper feeding unit 6 has a manual tray 4 provided at one side portion of the printer body 2 so as to be openable and closable, and a manual paper feeding roller 5 provided in the printer body 2 so as to be rotatable.

The cassette paper feeding unit 7 is provided at a bottom portion of the printer body 2. The cassette paper feeding unit 7 includes a paper feeding cassette 11 that stores a plurality of papers overlapped one another, a pick roller 12 that takes out the papers in the paper feeding cassette 11 one by one, and a feed roller 13 and a retard roller 14 that separate the taken-out papers one by one and send the separated paper to the conveyance path T.

The image forming unit 8 is provided above the cassette paper feeding unit 7 in the printer body 2. The image forming unit 8 includes a photosensitive drum 16 serving as an image carrying member provided in the printer body 2 so as to be rotatable, a charging device 17 arranged around the photosensitive drum 16, a developing unit 18, a transfer roller 19, a cleaning section 20, a laser scanner unit (LSU) 26 arranged above the photosensitive drum 16 and serving as an optical scanning device, and a toner hopper 21. In this way, the image forming unit 8 is configured to form an image on the paper supplied from the manual paper feeding unit 6 or the cassette paper feeding unit 7.

At the conveyance path T, a pair of resist rollers 15 are provided to temporarily keep the taken-out paper waiting and then supply the paper to the image forming unit 8 at a predetermined timing.

The fixing device 9 is arranged at a lateral side of the image forming unit 8. The fixing device 9 includes a fixing belt 22 and a pressure roller 23 brought into press-contact with the fixing belt 22 by an urging member (not illustrated). In this way, the fixing device 9 is configured to fix a toner image, which has been transferred to a paper in the image forming unit 8, to the paper.

The paper discharge unit 10 is provided above the fixing device 9. The paper discharge unit 10 includes a paper discharge tray 3, a paper discharge roller pair 24 for conveying papers to the paper discharge tray 3, and a plurality of conveying guide ribs 25 that guide papers to the paper discharge roller pair 24. The paper discharge tray 3 is formed in a concave shape at an upper portion of the printer body 2.

When the image forming apparatus 1 receives image data, the photosensitive drum 16 is rotationally driven and the charging device 17 charges the surface of the photosensitive drum 16 in the image forming unit 8.

Furthermore, on the basis of the image data, laser light is emitted to the photosensitive drum 16 from the laser scanner unit 26. The laser light is irradiated, so that an electrostatic latent image is formed on the surface of the photosensitive drum 16. The electrostatic latent image formed on the photosensitive drum 16 is developed by toner charged in the developing unit 18 and becomes a visible image as a toner image.

Thereafter, the paper passes through between the transfer roller 19 and the photosensitive drum 16, and a bias having a charged polarity opposite to that of toner is applied to the paper when the paper passes through. As a consequence, the toner image of the photosensitive drum 16 is transferred to the paper. The paper with the transferred toner image is heated and pressed by the fixing belt 22 and the pressure roller 23 in the fixing device 9. As a consequence, the toner image is fixed to the paper.

Figure 2:
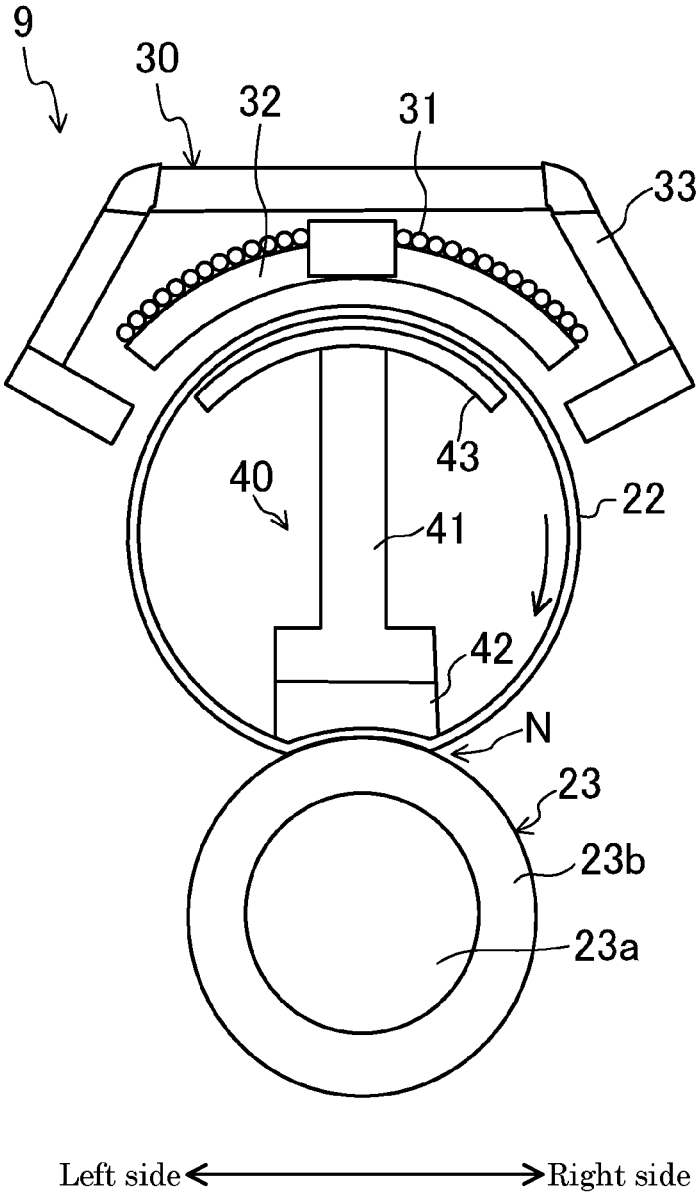
FIG. 2 is a schematic diagram illustrating a fixing device when viewed from a belt rotation shaft direction.

As illustrated in FIG. 2, the fixing device 9 includes the aforementioned fixing belt 22, the aforementioned pressure roller 23, an induction heating unit (a heating unit) 30, and a pressing member 40.

The pressure roller 23 is supported to a housing (not illustrated) of the fixing device 9 so as to be rotatable. The induction heating unit 30 and the pressing member 40 are fixedly supported to the housing of the fixing device 9.

The fixing belt 22 is an endless heat resistant belt and is configured by sequentially stacking, from an inner peripheral side, an induction heating layer made of an electroformed nickel, an elastic layer made of a silicon rubber and the like, and a release layer made of a fluororesin and the like, and improving release properties when an unfixed toner image is melted and fixed at a nip portion N. In FIG. 2, these layers are not distinguished from one another and have been drawn for the purpose of simplification.

The pressure roller 23 is supported to the housing of the fixing device 9 so as to be rotatable. The pressure roller includes a cored bar 23*a* made of a stainless steel and the like, an elastic layer 23*b* provided on an outer peripheral surface of the cored bar 23*a* and made of a silicon rubber and the like, and a release layer (not illustrated) covering the surface of the elastic layer 23*b* and made of a fluororesin and the like. Furthermore, the pressure roller 23 is rotationally driven by a driving source such as a motor (not illustrated), and the fixing belt 22 is rotated by the rotation of the pressure roller 23. At a part at which the pressure roller 23 and the fixing belt 22 are brought into press-contact with each other, the nip portion N is formed, and in the nip portion N, an unfixed toner image on a conveyed paper is heated and pressed and is fixed to the paper.

The pressing member 40 has a frame part 41, a pressing pad part 42, and an arc guide part 43. The pressing pad part 42 is arranged facing the pressure roller 23 while interposing the fixing belt 22 between the pressure roller 23 and the pressing pad part 42. The pressing pad part 42, for example, is made of liquid crystal polymer and presses the fixing belt 22 to the pressure roller 23 side. The pressure roller 23 is urged to the pressing pad part 42 side by an urging member (not illustrated). The pressure roller 23 is pressed to the pressing pad part 42 while interposing the fixing belt 22 between the pressing pad part 42 and the pressure roller 23. The arc guide part 43 is arranged at an opposite side of the pressing pad part 42 while interposing the rotation center of the fixing belt 22 between the pressing pad part 42 and the arc guide part 43. The arc guide part 43 has an arc-shaped section protruding upward. The arc guide part 43 is arranged facing the induction heating unit 30 and guides the inner peripheral surface of the fixing belt 22 such that the fixing belt 22 travels along the induction heating unit 30.

The induction heating unit 30 is arranged facing the fixing belt 22 so as to cover an upper end portion of the fixing belt 22 and heats the fixing belt 22 by electromagnetic induction. In detail, the induction heating unit 30 has a coil 31, a bobbin 32, and a magnetic substance core 33. The coil 31 is wound around the bobbin 32 a plurality of times along the rotation shaft direction of the fixing belt 22. The coil 31 is connected to a power source (not illustrated) and generates a magnetic field by a high frequency current supplied from the power source. A magnetic flux caused from the magnetic substance core 33 by the magnetic field of the coil 31 generates Joule heat by passing through the fixing belt 22. As a consequence, the fixing belt 22 generates heat. The aforementioned power source is controlled by a controller 100 (see FIG. 3) which will be described later.

Figure 3:
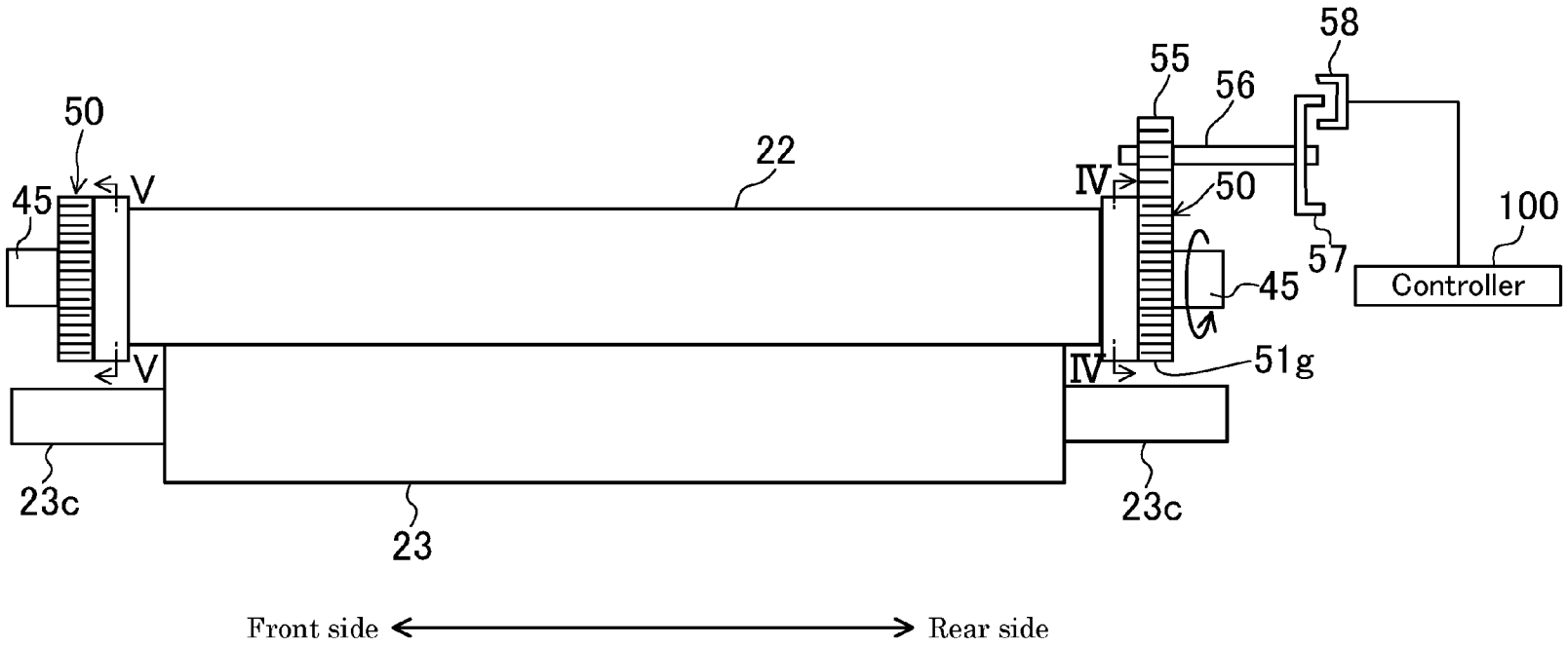
FIG. 3 is a side view illustrating a fixing device when viewed from a direction perpendicular to a belt rotating shaft.

As illustrated in FIG. 3, the fixing device 9 further includes a pair of cap members 50 mounted at both ends of the fixing belt 22 in the rotation shaft direction (the front and rear direction), a member 57 to be detected, which is rotated according to one cap member 50, and a rotation detection sensor (a rotation detection unit) 58 that detects the rotation of the member 57 to be detected.

The cap member 50 has a cylindrical part 51 (see FIG. 4) that covers an end portion of the fixing belt 22 in the rotation shaft direction from a radial direction outside, and a disc part 52 that covers one end side of the cylindrical part 51 in an axial direction. The other end side of the cap member 50 in the axial direction is opened. The cap member 50 is fitted onto an end portion of the fixing belt 22 in the axial direction from the opening side. The disc part 52 is formed at a center portion thereof with a through hole 52*a*. The aforementioned pressing member 40 is fixed to the housing of the fixing device 9 via a connection member 45 (illustrated only in FIG. 3) passing through the through hole 52*a*.

At an outer peripheral surface of the aforementioned cylindrical part 51, a gear portion 51*g* (see FIG. 3) is formed to be engaged with a driven gear 55. The driven gear 55 is connected to the member 57 to be detected via a connection shaft 56, wherein the member 57 to be detected has a cylindrical cap shape. The rotation detection sensor 58 includes a PI sensor having a light emitting part and a light receiving part. The rotation detection sensor 58 is arranged such that a peripheral wall of the member 57 to be detected is positioned between the light receiving part and the light emitting part. The peripheral wall of the member 57 to be detected is formed with a slit hole for rotation detection. The rotation detection sensor 58 detects whether the member 57 to be detected rotates at a predetermined speed and outputs a detection signal to the controller 100.

The controller 100 includes a microcomputer having a CPU, a ROM, a RAM and the like. On the basis of the detection signal from the rotation detection sensor 58, the controller 100 determines whether the cap member 50 rotates at a predetermined speed. When it has been determined that the cap member 50 rotates at the predetermined speed (that is, when it has been determined that the fixing belt 22 does not slip and normally rotates), the controller 100 operates the induction heating unit 30, and when it has been determined that the cylindrical part 51 does not rotate at the predetermined speed (that is, when it has been determined that the fixing belt 22 slips), the controller 100 stops the operation of the induction heating unit 30.

Figure 4:
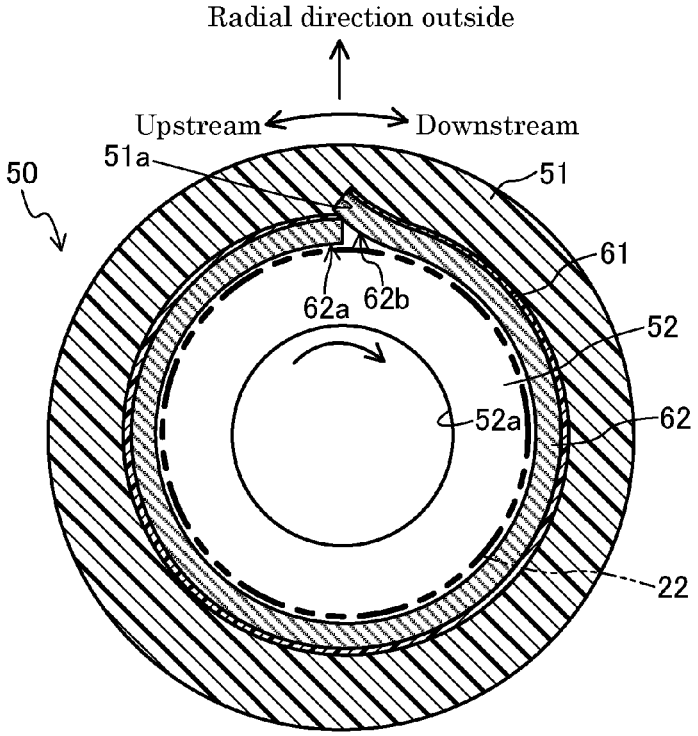
FIG. 4 is a sectional view taken along line IV-IV of FIG. 3.
Figure 5:
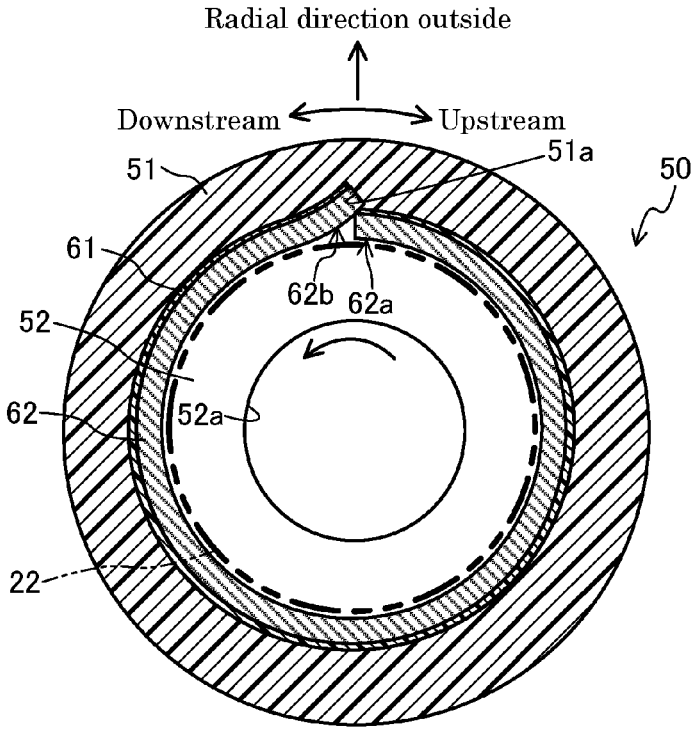
FIG. 5 is a sectional view taken along line V-V of FIG. 3.

FIG. 4 is a sectional view including one cap member 50 mounted at a rear end portion of the fixing belt 22, and FIG. 5 is a sectional view including the other cap member 50 mounted at a front end portion of the fixing belt 22. Herein, both cap members 50 can be seen such that inclination directions of storage recessed portions 51*a* are different from each other, but the inclination directions of both storage recessed portions 51*a* are equal to each other in relation to the rotation direction of the fixing belt 22. Consequently, hereinafter, with reference to FIG. 4, only the one cap member 50 will be described and a description of the other cap member 50 will be omitted.

The cap member 50, for example, is configured by a resin material. A rotation transfer member 62 is mounted at the inner peripheral surface of the cylindrical part 51 of the cap member 50 to transfer the rotation of the fixing belt 22 to the cap member 50. The rotation transfer member 62 is formed in an approximately annular shape by allowing two facing end edges 62*a* and 62*b* of a rectangular sheet material to be brought close to each other. The sheet material includes an elastic member such as a rubber. An outer peripheral surface of the rotation transfer member 62 has been bonded to the inner peripheral surface of the cylindrical part 51 by a double-sided tape 61 serving as a bonding material. The cylindrical part 51 is formed at the inner peripheral surface thereof with the storage recessed portion 51*a* inclined to an upstream side in a belt rotation direction toward the radial direction outside when viewed from a cylinder axis direction. The storage recessed portion 51*a* is formed over about the whole in an axial direction at the inner peripheral surface of the cylindrical part 51. The storage recessed portion 51*a* is engaged with the end edge 62*b* of a downstream side in the belt rotation direction (the rotation direction of the fixing belt 22) of the aforementioned two facing end edges 62*a* and 62*b* of the rotation transfer member 62. In this way, the storage recessed portion 51*a* stores the end edge 62*b* in the state in which the storage recessed portion 51*a* has been separated to the radial direction outside from the outer peripheral surface of the fixing belt 22. In this way, the end edge 62*b* of the downstream side of the rotation transfer member 62 is arranged so as to ride up to the radial direction outside the end edge 62*a* of an upstream side.

In the state in which the aforementioned cap member 50 has been mounted at the fixing belt 22 (see the two dot chain line of FIG. 4), the rotation transfer member 62 is compressively deformed between the outer peripheral surface of the fixing belt 22 and the inner peripheral surface of the cylindrical part 51. The rotation transfer member 62 is compressively deformed, so that large frictional force (so-called grip force) is generated between the outer peripheral surface of the fixing belt 22 and the inner peripheral surface of the rotation transfer member 62. In this way, the rotation of the fixing belt 22 is transferred to the cap member 50 via the rotation transfer member 62.

The aforementioned frictional force acts in the direction in which of the two end edges 62*a* and 62*b* in the rotation transfer member 62 the end edge 62*b* positioned at the downstream side is separated from the inner peripheral surface of the cylindrical part 51. Therefore, in the conventional fixing device, the end edge 62*b* of the downstream side may be separated from the inner peripheral surface of the cylindrical part 51 during the rotation of the fixing belt 22.

However, in the aforementioned embodiment 1, the end edge 62*b* of the downstream side in the rotation transfer member 62 is engaged with the storage recessed portion 51*a* formed at the inner peripheral surface of the cylindrical part 51 and is positioned at the radial direction outside from the outer peripheral surface of the fixing belt 22. Consequently, frictional force from the fixing belt 22 is prevented from directly acting on the end edge 62*b* of the downstream side in the rotation transfer member 62, so that it is possible to suppress the separation of the end edge 62*b* of the downstream side. Thus, it is possible to prevent the rotation transfer efficiency of the rotation transfer member 62 from being reduced by the separation of the end edge 62*b* of the downstream side of the rotation transfer member 62. Accordingly, the rotation of the cap member 50 (the cylindrical part 51) and the rotation of the fixing belt 22 can be reliably synchronized with each other. Thus, it is possible to accurately perform the rotation detection of the fixing belt 22 using the cap member 50.

Furthermore, the aforementioned storage recessed portion 51*a* is inclined to the upstream side in the belt rotation direction toward the radial direction outside when viewed from the cylinder axis direction of the cylindrical part 51.

In this way, large bending force does not act on a base of a part (the end edge 62*b* of the downstream side) stored in the storage recessed portion 51*a* in the rotation transfer member 62, so that the end edge 62*b* of the downstream side in the rotation transfer member 62 can be separated outward from the outer peripheral surface of the fixing belt 22.

Embodiment 2

Figure 6:
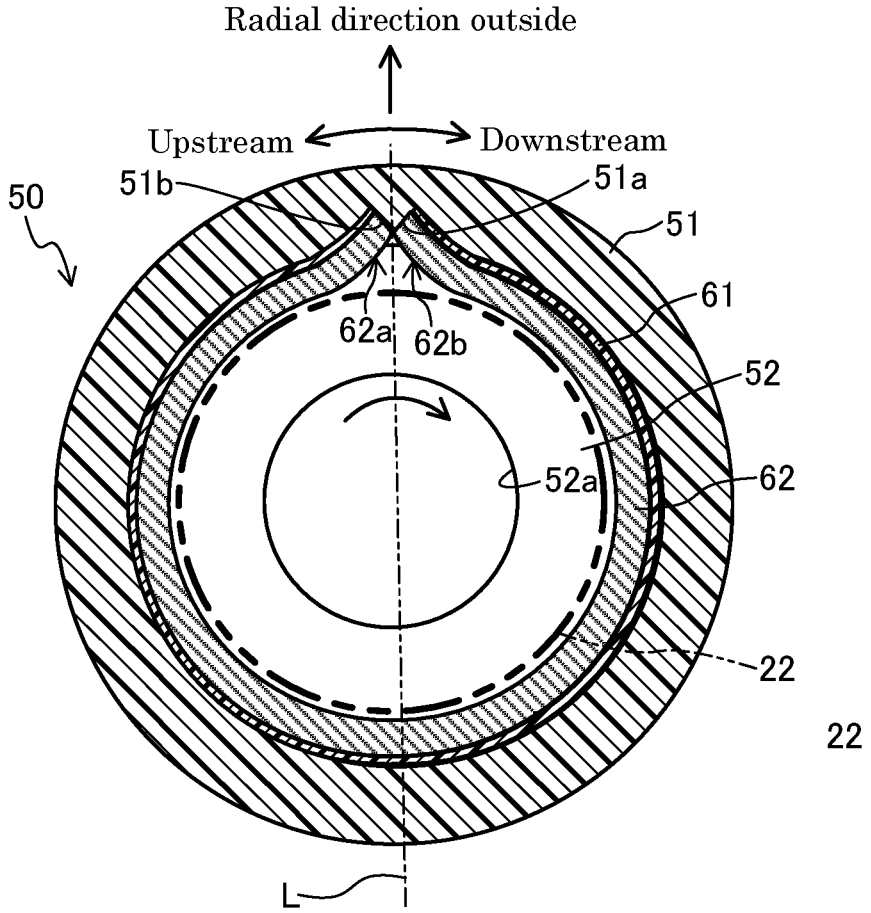
FIG. 6 is a view corresponding to FIG. 4 and illustrating an embodiment 2.

FIG. 6 illustrates an embodiment 2. The present embodiment is different from the aforementioned embodiment 1 in that first and second storage recessed portions 51*a* and 51*b* are formed at the inner peripheral surface of the cylindrical part 51. The same reference numerals are used to designate the same elements as those of the embodiment 1 and a detailed description thereof will be omitted.

The first storage recessed portion 51*a* stores the end edge 62*b* of the downstream side in the rotation transfer member 62 in the belt rotation direction. The second storage recessed portion 51*b* stores the end edge 62*a* of the upstream side in the rotation transfer member 62 in the belt rotation direction.

The first storage recessed portion 51*a* is inclined to the upstream side of the belt rotation direction toward the radial direction outside when viewed from the cylinder axis direction of the cylindrical part 51. The second storage recessed portion 51*b* is inclined to the downstream side in the belt rotation direction toward the radial direction outside when viewed from the cylinder axis direction of the cylindrical part 51. The inclination angle of the first storage recessed portion 51*a* and the inclination angle of the second storage recessed portion 51*b* are equal to each other. The first storage recessed portion 51*a* and the second storage recessed portion 51*b* are formed in line symmetry with respect to a straight line L passing through a boundary between both storage recessed portions 51*a* and 51*b* after passing through an axis center of the cylindrical part 51.

According to the fixing device 9 of the aforementioned embodiment 2, in the cylindrical part 51 mounted at one end portion of the fixing belt 22 in the rotation shaft direction and the cylindrical part 51 mounted at the other end, their shapes are not needed to be different from each other. Thus, it is possible to prevent erroneous assembly in which the cylindrical part 51 to be mounted at the one end portion of the fixing belt 22 is mounted at the other end portion. Furthermore, a worker can assemble the cylindrical part 51 to the fixing belt 22 without caring the rotation direction of the fixing belt 22, so that work load is reduced.

Other Embodiments

In the aforementioned embodiment, the cap member 50 has the cylindrical part 51 and the disc part 52; however, the disc part 52 is not always necessary.

In the aforementioned embodiment, the double-sided tape is used as a bonding material for bonding the rotation transfer member 62 to the cylindrical part 51; however, the present invention is not limited thereto and the bonding material, for example, may also be configured with a light curing resin or a thermosetting resin.

What is claimed is:

1. A fixing device comprising:

an endless fixing belt;

a heating unit that heats the fixing belt;

an abutting member arranged inside the fixing belt and abutting an inner peripheral surface of the fixing belt;

a pressure roller brought into press-contact with the abutting member at a predetermined pressure while interposing the fixing belt between the abutting member and the pressure roller, thereby forming a fixing nip portion between the fixing belt and the pressure roller and applying rotational driving force to the fixing belt in a predetermined direction;

a cylindrical part arranged to cover an outer peripheral surface of an end portion of the fixing belt in a rotation shaft direction;

a rotation transfer member formed in an approximately annular shape by allowing two facing end edges of a rectangular sheet material including an elastic member to be brought close to each other, and held between an inner peripheral surface of the cylindrical part and an outer peripheral surface of the fixing belt to transfer rotation of the fixing belt to the cylindrical part;

a bonding material that bonds the rotation transfer member to the inner peripheral surface of the cylindrical part; and a rotation detection unit that detects rotation of the cylindrical part, wherein the cylindrical part is formed at the inner peripheral surface thereof with a first storage recessed portion that stores an end edge positioned at a downstream side in a belt rotation direction of the two facing end edges in the rotation transfer member.

2. The fixing device of claim 1, wherein the first storage recessed portion is inclined to an upstream side of the belt rotation direction toward a radial direction outside when viewed from an axial direction of the cylindrical part.

3. The fixing device of claim 2, wherein the cylindrical part is provided at both ends of the fixing belt in a rotation shaft direction, and the cylindrical part is further formed at the inner peripheral surface thereof with a second storage recessed portion engaged with an end edge positioned at the upstream side in the belt rotation direction of the two facing end edges in the rotation transfer member.

4. The fixing device of claim 3, wherein the first storage recessed portion is inclined to the upstream side in the belt rotation direction toward the radial direction outside when viewed from the axial direction of the cylindrical part, the second storage recessed portion is inclined to the downstream side in the belt rotation direction toward the radial direction outside when viewed from the axial direction of the cylindrical part, and an inclination angle of the first storage recessed portion and an inclination angle of the second storage recessed portion are equal to each other.

5. An image forming apparatus comprising the fixing device of claim 1.

* * * * *